US010858867B2

(12) United States Patent
Pudney et al.

(10) Patent No.: US 10,858,867 B2
(45) Date of Patent: Dec. 8, 2020

(54) VEHICULAR DOOR HANDLE ASSEMBLY AND METHOD FOR ASSEMBLING THE SAME

(71) Applicant: Novares US LLC, Livonia, MI (US)

(72) Inventors: Richard Pudney, Plymouth, MI (US); David Brent Egnor, Ypsilanti, MI (US); Timothy Bugenski, Sterling Heights, MI (US)

(73) Assignee: Novares US LLC, Livonia, MI (US)

( * ) Notice: Subject to any disclaimer, the term of this patent is extended or adjusted under 35 U.S.C. 154(b) by 422 days.

(21) Appl. No.: 15/674,513

(22) Filed: Aug. 10, 2017

(65) Prior Publication Data

US 2019/0048628 A1 Feb. 14, 2019

(51) Int. Cl.

| | |
|---|---|
| ***E05B 79/06*** | (2014.01) |
| ***E05B 85/16*** | (2014.01) |
| *E05B 77/06* | (2014.01) |
| *E05B 85/10* | (2014.01) |

(52) U.S. Cl.

CPC ..... *E05B 85/16* (2013.01); *E05B 79/06* (2013.01); *E05B 77/06* (2013.01); *E05B 85/10* (2013.01); *Y10T 292/57* (2015.04)

(58) Field of Classification Search

CPC ..... Y10T 292/57; E05B 85/10; E05B 79/06
See application file for complete search history.

(56) References Cited

U.S. PATENT DOCUMENTS 1,519,500 A * 12/1924 Miller ..... G05G 1/12 292/356
1,519,503 A * 12/1924 Norwood ..... G05G 1/12 292/356
3,044,817 A * 7/1962 Marcante ..... E05B 3/003 292/336.3
5,123,687 A * 6/1992 Pfeiffer ..... E05B 1/0092 292/336.3

(Continued)

FOREIGN PATENT DOCUMENTS

EP 1052349 A1 * 11/2000 ..... E05B 85/16
EP 1306503 A1 * 5/2003 ..... E05B 79/06

(Continued)

OTHER PUBLICATIONS

Notification of Transmittal of the International Search Report and Written Opinion of the International Searching Authority (PCT/ISA/220/210/237) dated Nov. 26, 2018 (13 pages).

*Primary Examiner* — Carlos Lugo
(74) *Attorney, Agent, or Firm* — Gunther J. Evanina; Butzel Long

(57) ABSTRACT

A vehicular door handle assembly for opening a vehicle door is provided and includes a chassis assembly having a forward end and a rearward end. The forward end includes an arm rotatable about an axis perpendicular to the longitudinal axis of the chassis and the rearward end includes a rotatable bellcrank. The vehicular door handle assembly further includes a handle grip movable to an actuated position to open a vehicle door and the handle grip includes a forward end and a rearward end. The forward end includes a con- (Continued)

nection member to rigidly connect with the rotatable arm and the rearward end includes a plunger rotatably connected to the rear end door handle and is rotatably connected to the bellcrank.

8 Claims, 10 Drawing Sheets

(56) References Cited

U.S. PATENT DOCUMENTS 5,400,473 A * 3/1995 Delman ..... E05F 11/16 16/429
6,363,577 B1 * 4/2002 Spitzley ..... E05B 79/06 16/438
6,543,090 B2 * 4/2003 Muneta ..... E05B 79/06 16/412
7,152,893 B2 * 12/2006 Pudney ..... E05B 13/002 292/336.3
7,431,357 B2 * 10/2008 Pudney ..... E05B 85/16 292/336.3
7,513,544 B2 * 4/2009 Cummins ..... E05B 47/004 292/336.3
8,070,194 B2 * 12/2011 Houis ..... E05B 3/00 16/412
8,201,859 B2 * 6/2012 Steelman ..... E05B 85/12 292/292
8,459,706 B2 * 6/2013 Yoshino ..... E05B 79/06 292/336.3
8,746,758 B2 * 6/2014 Savant ..... E05B 77/06 292/336.3
8,777,281 B2 * 7/2014 Saitou ..... E05B 79/06 292/336.3
9,605,451 B2 * 3/2017 Patel ..... E05B 79/06
2014/0265373 A1 9/2014 Patel
2016/0160538 A1 6/2016 Mathofer

FOREIGN PATENT DOCUMENTS

EP 1355022 A2 * 10/2003 ..... E05B 79/06
EP 3361026 A1 * 8/2018 ..... E05B 79/06
FR 2878278 A1 * 5/2006 ..... E05B 79/06
WO WO 2016/155934 A1 10/2016

* cited by examiner

VEHICULAR DOOR HANDLE ASSEMBLY AND METHOD FOR ASSEMBLING THE SAME

FIELD

The present disclosure relates generally to vehicular door handle assemblies.

BACKGROUND

The statements in this section merely provide background information related to the present disclosure and may not constitute prior art.

Vehicular door handle assemblies typically comprise two sub-components, i.e. a handle assembly and a chassis assembly. The chassis assembly is secured onto the internal side of a metal sheet which forms the vehicular door and the handle assembly is connected to the chassis assembly through a first forward passageway and a second rearward passageway provided in the vehicular door. The door handle is typically a sub-component which is typically an assembly with several parts including gaskets, handle cover, and a core, among others. At its forward end, a door handle is conventionally provided with a pivot extension and a plunger. The pivot extension is inserted in the forward passageway and the plunger is inserted in the second passageway to engage a bellcrank which in turn is linked to a lock mechanism.

Prior art door handles prove not to be entirely satisfactory as they tend to have an unstable operation.

SUMMARY

The present disclosure provides a vehicular door handle assembly for opening a vehicle door said handle assembly comprising:

a chassis assembly having a forward end and a rearward end;

said forward end having an arm rotatable about an axis perpendicular to the longitudinal axis of the chassis;

said second end having a rotatable bellcrank; and a handle grip movable to an actuated position to open a vehicle door, having a forward end and a rearward end;

said forward end having a connection features to rigidly connect with the rotatable arm;

said rearward end having a plunger rotatably connected to the rear end door handle and rotatably connected to the bellcrank.

In one form, the arm is provided with connection features and the handle grip forward end is provided with complementary connection features configured to rigidly couple the handle grip on the arm when the handle grip is superimposed with the chassis longitudinal axis.

In another form, the arm is provided with a series of radial lugs and the handle grip front end is provided with a series of radial grooves sized and spaced to receive the series of radial lugs alternating with a series of radial retaining lips sized and spaced to retain the series of radial tabs.

In one variation, the handle grip includes a plunger rotatably coupled to the handle grip rear end.

In another variation, the handle grip includes a frame whereon a plunger is rotatably coupled and a handle shell.

In yet another variation, the handle shell and the frame define a cavity where the plunger can seat in a waiting position.

In still another variation, the bellcrank includes at least one locking clips configured to engage at least one pin of the plunger.

The present disclosure further provides a vehicular door handle assembly for opening a vehicle door securable on a vehicular door provided with a first forward passageway and a second rearward passageway, said handle vehicular door handle assembly comprising:

a chassis configured to be secured on an internal face of the vehicle door assembly having a forward end and a rearward end, said forward end having an arm rotatable about an axis perpendicular to the longitudinal axis of the chassis, said second end having a rotatable bellcrank connectable to a door latch mechanism; and a door handle movable to an actuated position to open a vehicle door having a forward end and a rearward end, said forward end having a connection features to rigidly connect with the rotatable arm, said rearward end having a plunger rotatably connected to the rear end door handle and rotatably connected to the bellcrank.

In one form, the arm is coupled to the chassis by a pivot linkage wider than the forward passageway provided in the vehicle door metal sheet.

In another form, the pivot linkage coupling the arm on the chassis 2 is located on the internal side of the vehicular door and the rigid linkage coupling the arm on the handle grip forward end is located on the external side of the vehicular door.

The present disclosure further provides a method of installing a vehicle door handle on a vehicular door having an external side and an internal side and at least a front passageway and a second passageway, the method comprising the steps of:

providing a chassis assembly having a forward end and a rearward end, said forward end having an arm rotatable about an axis perpendicular to the longitudinal axis of the chassis said second end having a rotatable bellcrank;

securing the chassis assembly on the internal side of the door;

placing the arm in the position wherein the arm protrudes externally through the forward passageway above the surface of the door;

providing a handle grip movable to an actuated position to open a vehicle door, having a forward end and a rearward end, said forward end having a connection features to rigidly connect with the rotatable arm; said rearward end having a plunger rotatably connected to the rear end door handle and rotatably connected to the bellcrank;

mounting the handle grip forward end on the arm; and moving by rotation the door handle toward the chassis assembly rearward end thereby connecting the handle grip on the bellcrank.

In one form, mounting the handle grip forward end on the arm includes the steps of:

provided the arm with a series of radial lugs;

providing the handle grip front end with a series of radial grooves sized and spaced to receive the series of radial lugs alternating with a series of radial retaining lips sized and spaced to retain the series of radial tabs;

positioning the handle grip in an oblique angle relation to the chassis assembly axis so that the radial lugs engage into the radial grooves; and moving the handle grip in an angle where the handle grip is superimposed to the assembly axis so that the radial lugs engage the retaining lips.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
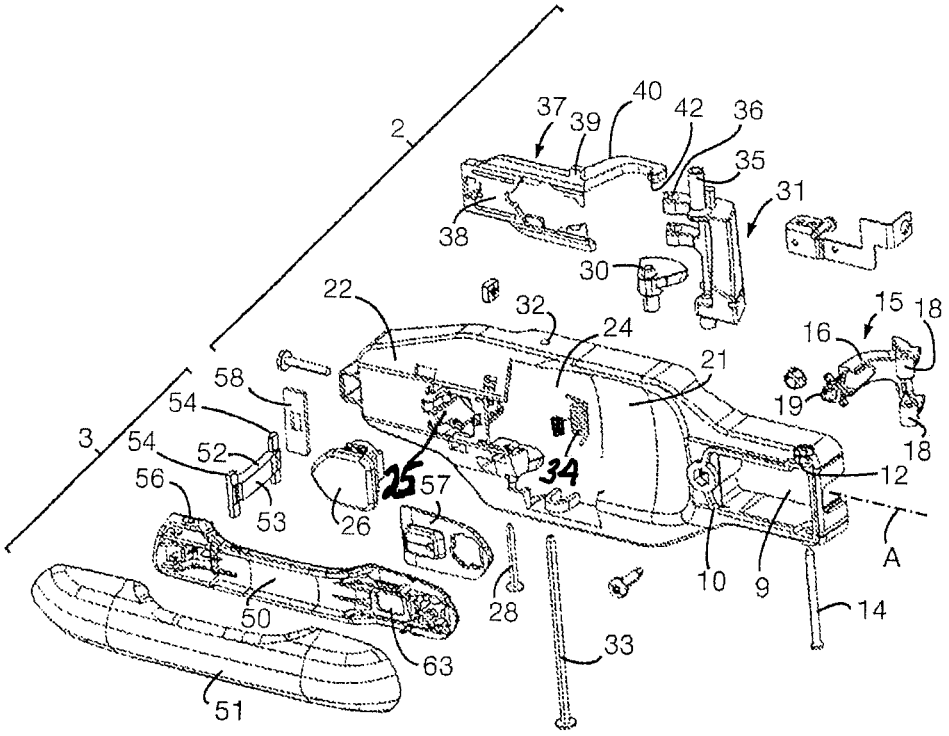
FIG. 1 is an exploded perspective view of a door handle assembly according to the present disclosure.
Figure 2:
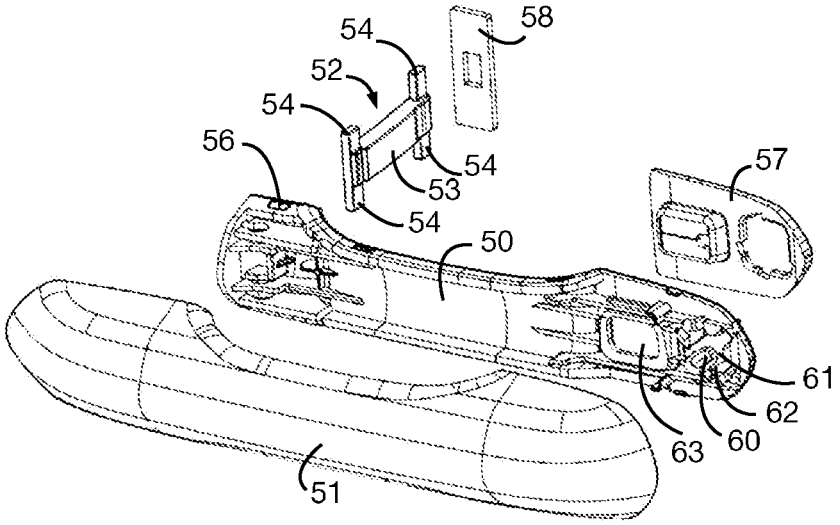
FIG. 2 is an exploded perspective view of a handle grip of the door handle assembly of FIG. 1.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides a door handle assembly and a method for installing the door handle assembly on a vehicle door.

It should be understood that the door handle assembly as described herein is characterized with respect to a forward, rearward, upper, and lower orientation, wherein forward is toward a front end of the vehicle, rearward is toward a rear end of the vehicle, external is away from the center of the vehicle and internal is closer to the center vehicle. This orientation is for exemplary purposes only and is not meant to limit the present disclosure in any manner. It will be apparent to one of ordinary skill in the vehicular handle art that the door handle assembly can be positioned on a vehicular door in any suitable fashion.

Referring now to FIGS. 1 to 18, the present disclosure is described in relation to exemplary variations thereof.

As shown, the vehicular door handle assembly of the present disclosure includes two subcomponents, namely, a chassis 2 and a handle grip 3.

The chassis 2 can be a plastic component which can be made by injection molding but other suitable materials are contemplated. The chassis 2 has an external face which is intended to face the internal face of an exterior vehicle door panel which can be made of metal or of any other suitable material and an internal face opposite the external face.

Figure 17:
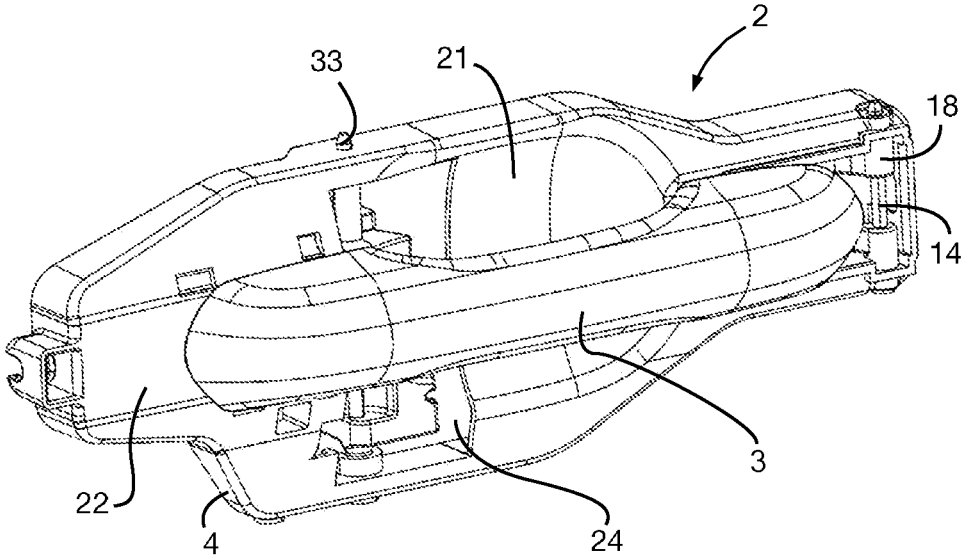
FIG. 17 illustrates an external view of a door handle assembly in an assembled fashion according to the present disclosure.
Figure 18:
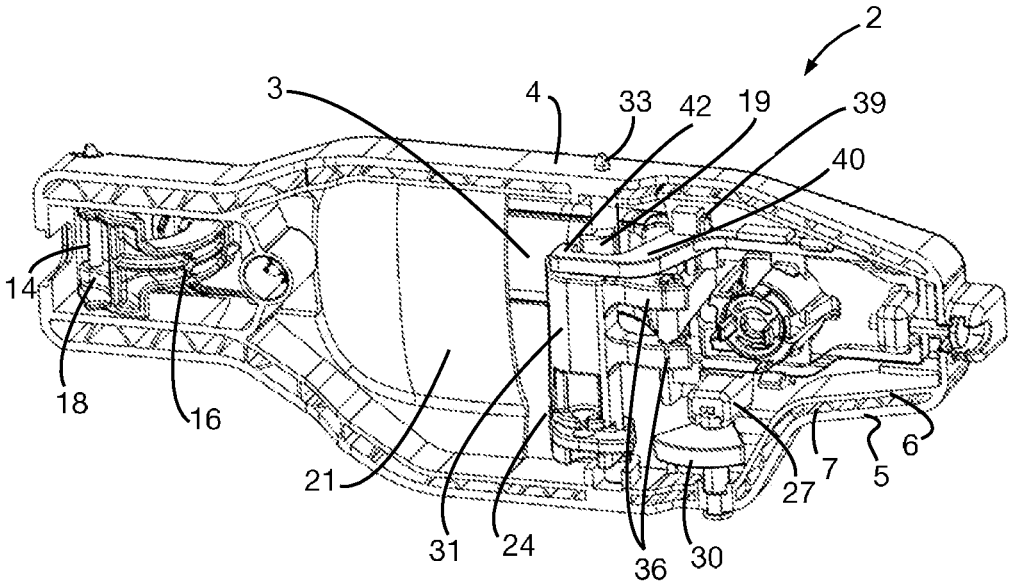
FIG. 18 illustrates an internal view of a door handle assembly in an assembled fashion according to the present disclosure.

As can be seen on FIG. 17, the chassis 2 includes a peripheral ridge 4 which makes provision for the chassis rigidity.

In the illustrated form of the present disclosure, the peripheral ridge 4 is comprised of two walls 5 and 6 linked by a series of ribs 7.

In the illustrated form, the chassis 2 has an elongated shape and has a longitudinal axis A.

At its forward end, the chassis 2 is provided with a first opening 9. The first opening 9 has a generally rectangular shape. The first opening 9 can be equipped with rib structure 10 that contacts the internal face of a door panel when the chassis 2 is assembled to a door structure. Two holes 12 are provided in the wall which surrounds the front opening 9, and a pivot pin 14 is inserted in the holes 12.

A rotatable arm 15 is mounted within the front opening of the chassis 2. To this end, the arm 15 has a central curved section 16 and a fork having two plain bearings 18 wherein the pivot pin 14 is inserted. The arm 15 is thus sturdily connected to the chassis 2 as the pivot linkage which connects the arm 15 to the chassis 2 can extend over a significant transversal dimension. At its free end, the arm 15 includes a series of radial lugs 19.

Next to the first opening 9, the chassis 2 includes with a central wall 21 that extends transversally within the peripheral ridge 4.

At its second end, the chassis 2 includes a support section 22 which extends within the peripheral ridge 4 at the rearward end of the chassis 2.

As it can be seen on the Figures, the transversal wall 21 and the support section 22 are spaced apart. In other words, the chassis 2 is provided with a central opening 24 which is defined between the transversal wall 21 and the support section 22.

In the illustrated example of the present disclosure, the support section 22 can be provided with a funnel 25 which extends from the internal face of the chassis 2. The funnel 25 is configured to accommodate a plug 26. In one form, the plug 26 can include a locking cylinder or any suitable mechanism for locking and unlocking the vehicle with a key.

The internal face of the chassis 2 is also equipped with a lug 27 provided with a hole suitable to receive a pivot pin 28. An inertia lock 30 is mounted on the pivot pin 28 and is configured to inhibit the vehicle door from opening in the case of a deceleration force caused by an impact with the vehicle.

A bellcrank 31 is also rotatably mounted on the chassis 2. To this end, the chassis 2 is provided with two holes 32 which are formed in the peripheral ridge 4. A pivot pin 33 is inserted in the holes 32. The bellcrank 31, which includes a plain bearing 35, is engaged on the pivot pin 33 and thus the bellcrank 31 can rotate about the pivot pin 33. The bellcrank 31 is biased by a torsion coil spring 34 toward a locked position that is to say a position where the door is latched by suitable means onto the vehicle body.

The central opening 24 is sized and shaped to accommodate the bellcrank 31 and to allow rotation of the bellcrank 31 between a vehicle door locked position and a vehicle door actuated position. To this end, the vehicle door is suitably equipped with appropriate features to latch and actuate the vehicle door upon an action by a user on the door handle.

The bellcrank 31 is also equipped with a fork which has two locking clips 36, each locking clip 36 including two curved arms.

In an exemplary form, the chassis 2 further includes a sliding member 37. The sliding member 37 can move between a first rearward position and a second frontward position. The sliding member 37 can thus occupy (i) a first waiting position where the sliding member 37 maintains the bellcrank 31 against the spring 34 in position where the locking clips 36 are substantially flush with the central opening; and (ii) a second operational/working position where the sliding member 37 releases the rotation of the bellcrank 31.

The sliding member 37 is provided with a sliding part 38 and an arm 40. The sliding part 38 is suitably equipped with guiding tabs 39 which make it possible to guide the sliding member 37 in its move with regards to the chassis 2. The arm 40 has a C-shape or gooseneck shape which goes around the bellcrank 31 and the end of which is fitted with a hook 42.

Referring to figures and particularly to FIGS. 2 to 5, in an exemplary form, the handle grip 3 comprises a frame 50 which supports a handle shell 51. The frame 50 supports at its rearward end a rotatable plunger 52 and is further provided, at its forward end, with a connecting feature configured to engage the rotatable arm 15 in a rigid manner.

The frame 50 has a general elongated and arcuate shape which makes it possible to accommodate a user's hand.

The handle shell 51 is positioned over the frame 50 and is suitably secured thereto by a series of tabs or similar suitable connectors which secure the hand shell on the frame 50.

Figure 3:
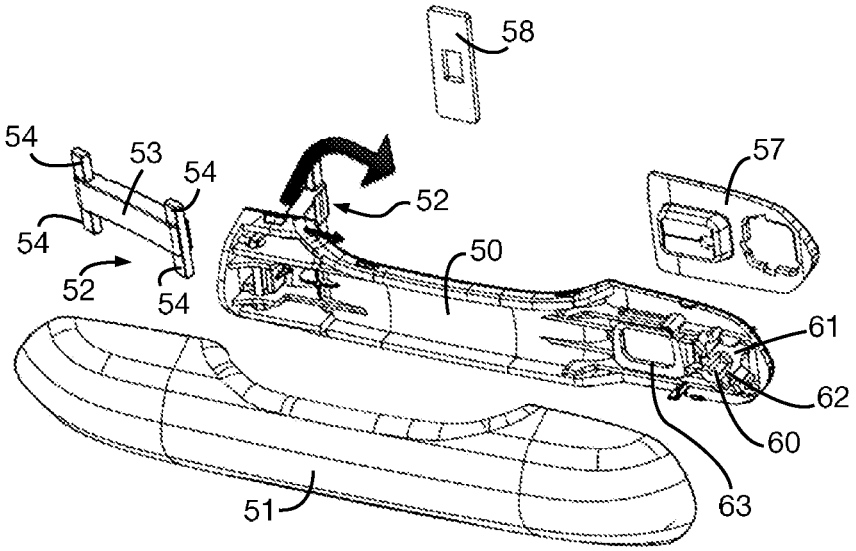
FIG. 3 is an a partially exploded perspective view of a handle grip according to the present disclosure.

Referring, for example, to FIGS. 1 to 7, the plunger 52 includes a central part 53 and four pins 54 positioned at both ends of the central part. Thus, the plunger 52 is connected to the frame 50 via a pivot linkage. The frame 50 is suitably provided with two holes 56 where two pins of the plunger 52 can seat and rotate. FIG. 3 shows the engagement of plunger 52 pins in the holes 56 provided in the frame 50 and the plunger 52 rotation authorized by the pivot linkage between the plunger 52 and the frame 50.

The handle grip 3 can also be suitably provided with a forward gasket 57 and a rearward gasket 58. Gaskets 57 and 58 can be configured as separate items or can be part of the chassis 2 or attached to the handle grip 3 as shown in the Figures.

Figure 4:
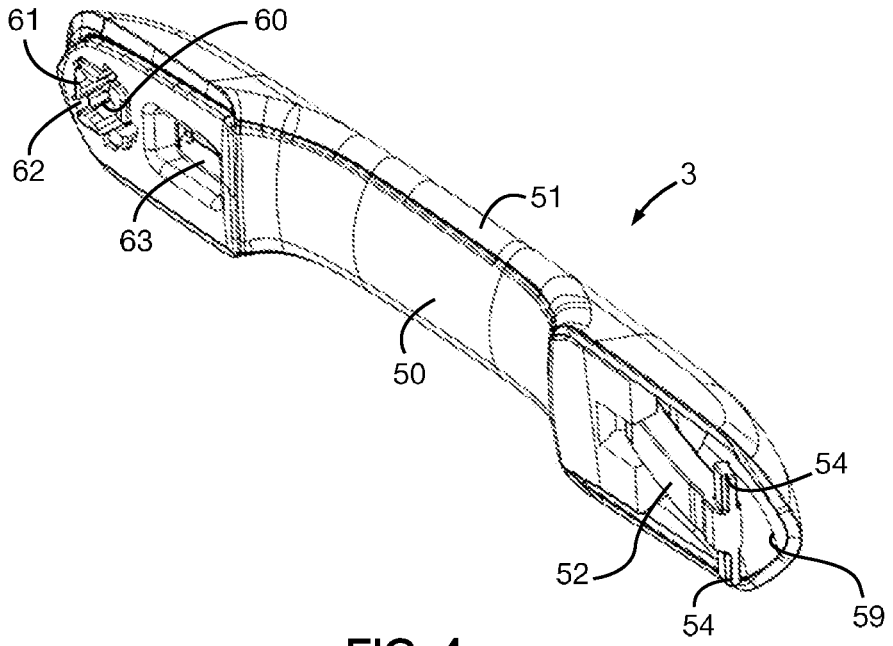
FIGS. 4 and 5 illustrate an internal view a handle grip according to the present disclosure.
Figure 5:
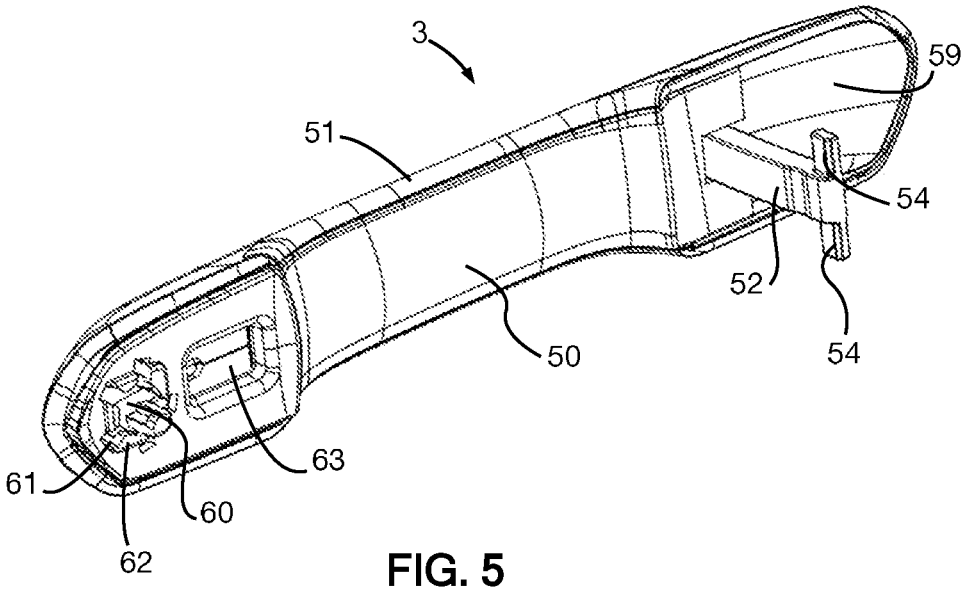

As shown in FIG. 4, the rearward end of the frame 50 is spaced from the rearward end of the handle shell 51 so as to define a cavity 59 where the plunger 52 can rest when, for example, the door handle is in a transport position.

Figure 6:
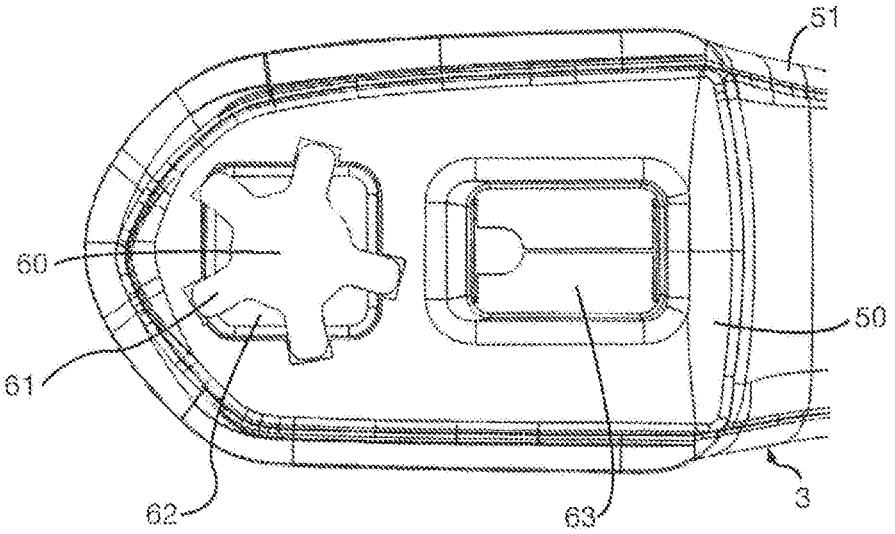
FIG. 6 illustrates an internal view of a handle grip forward end according to the present disclosure.
Figure 7:
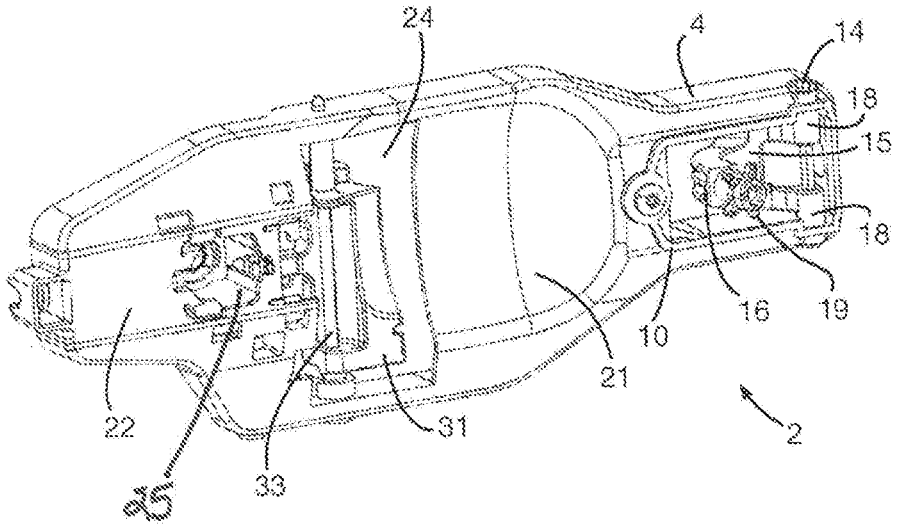
FIG. 7 illustrates an external perspective view of a chassis assembly of FIG. 1.
Figure 8:
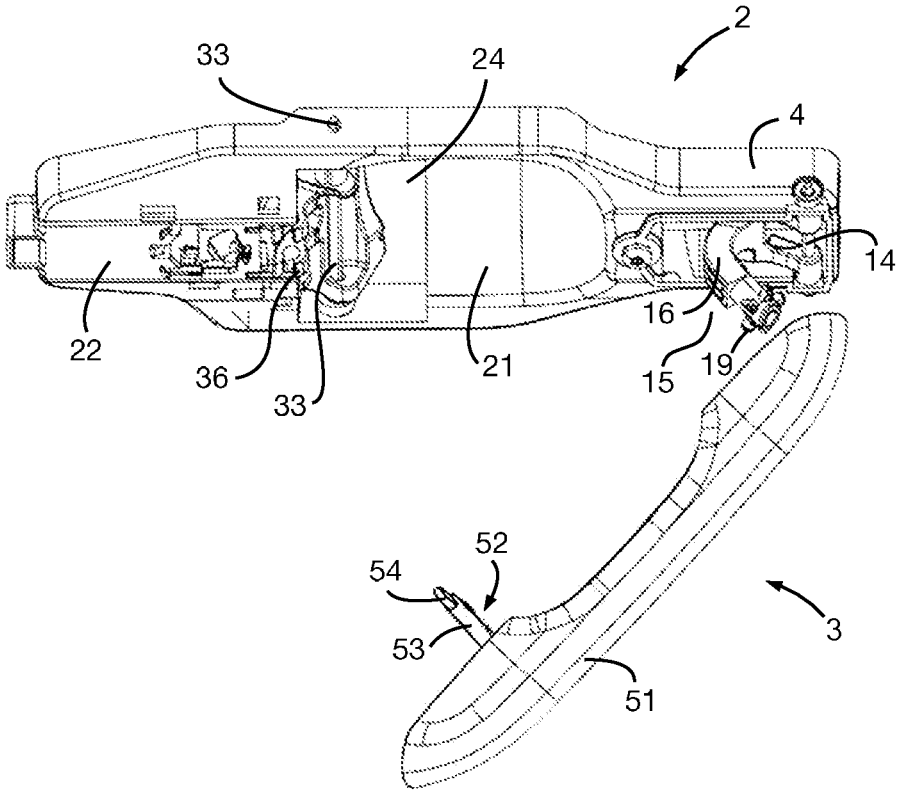
FIGS. 8 to 14 illustrate assembling operations of a door handle assembly according to the present disclosure.
Figure 9:
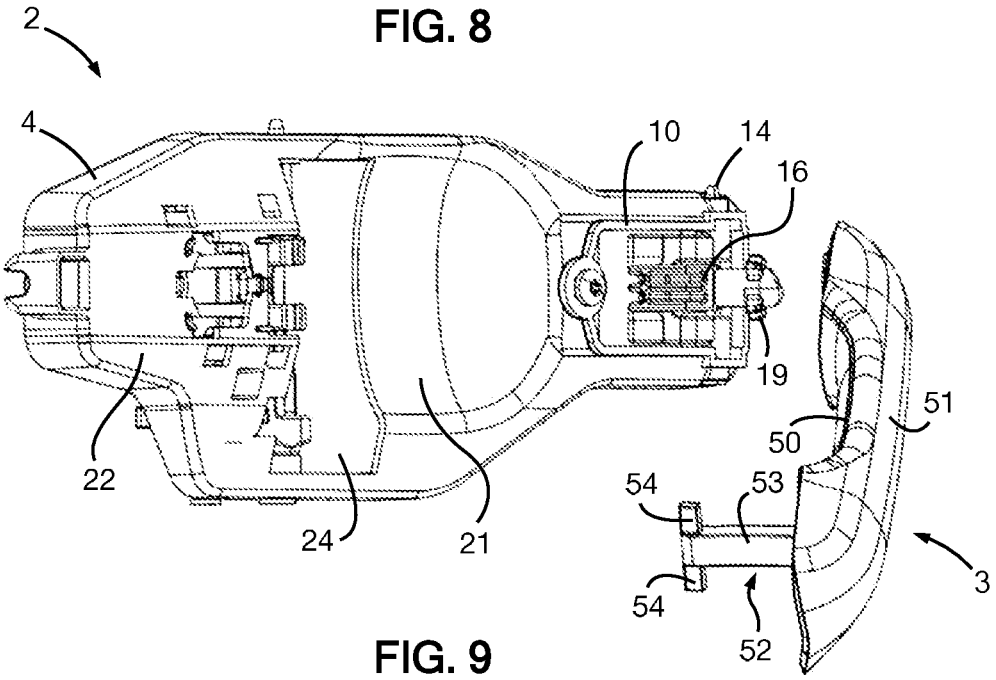
Figure 10:
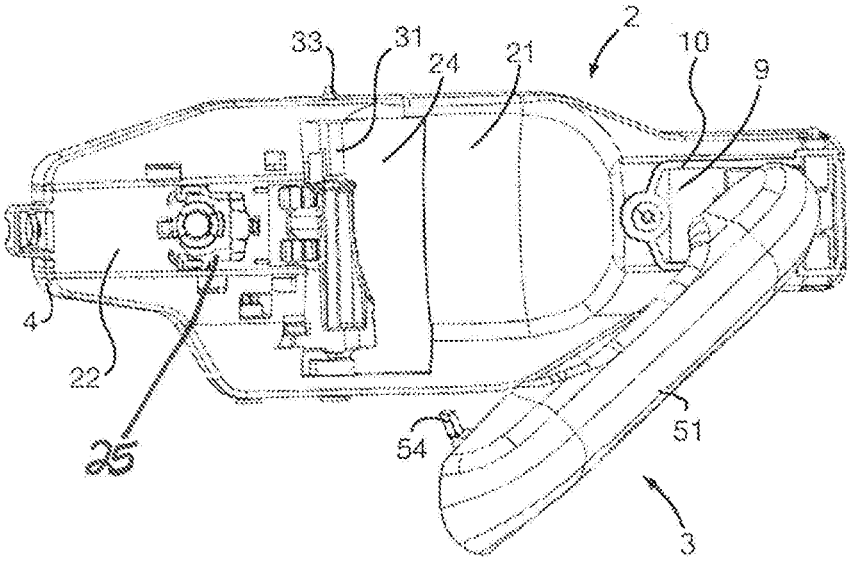

At its forward end, the frame 50 includes means for connection with the rotatable arm 15. In the illustrated example and as can be seen in FIG. 6, the frame 50 includes an opening 60 which has a series of radial grooves 61 alternating with a series of radial retaining lips 62 which are sized and spaced to accommodate the radial tabs 19. The radial grooves 61 and retaining lips 62 are spaced and oriented in manner such that when the frame 50 is placed in a position parallel to the frame A axis, the radial tabs 19 are locked by the retaining lips 62.

Adjacent to the means for connection with the rotatable arm 15, the frame 50 can include a passageway 63. This passageway 63 can be optionally used for wires connecting an electronic module located in the door handle.

The operation of assembling the door handle assembly 1 of the present disclosure includes a first stage where the chassis 2 is secured on the internal face of the metal sheet which forms the vehicle door, by any suitable attachment means such as a rivet or screw, among others.

Figure 11:
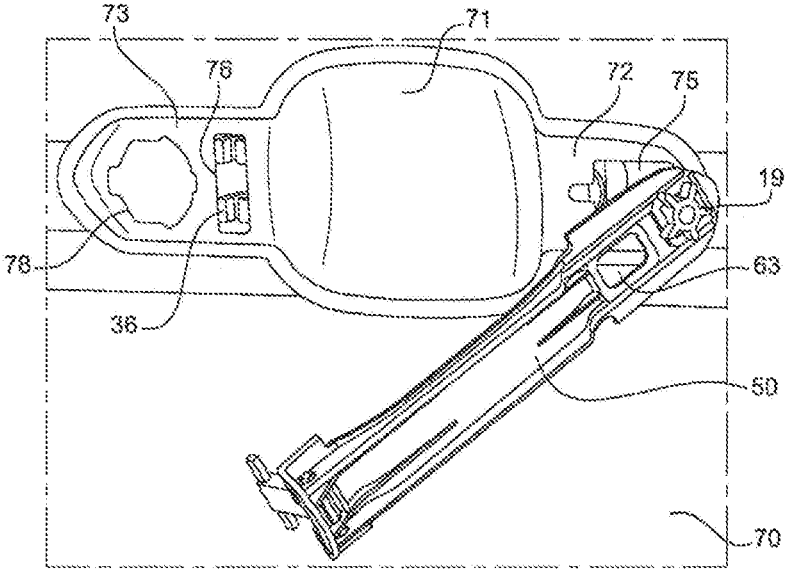
Figure 12:
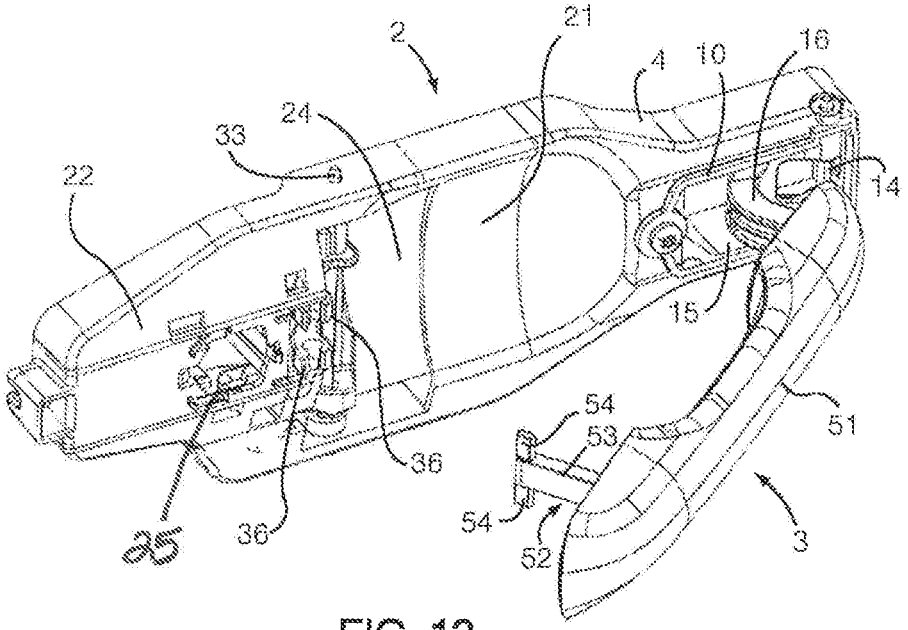
Figure 13:
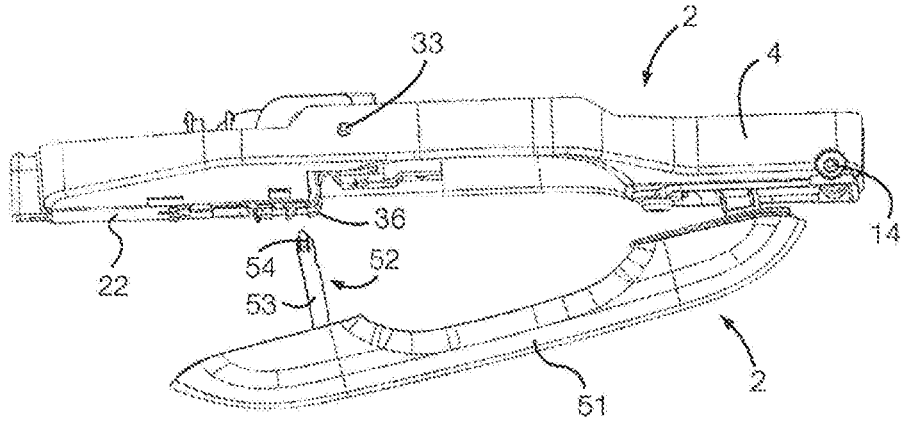

The door panel which can be seen in FIG. 11 is provided with an embossed area comprised of a central curved part 71 configured to accommodate the hand of a user, of a forward embossed section 72 and of a rearward embossed section 73. In the illustrated form, the forward embossed section 72 is provided with a passageway 75 which has a substantially rectangular shape and the rearward embossed section 73 is provided with a passageway 76 proximate the central curved part which has a rectangular slot shape and a distal passageway 78 which has a substantially round shape.

In a second stage shown in FIGS. 8 to 14, the forward end of the door handle is attached to the free end of the arm 15. To this end, the arm 15 is fully rotated and protrudes above the surface of the metal sheet.

The handle grip 3 is approached to the door panel embossed area and the attachment part of the chassis 2 is engaged on the arm free end. More precisely, in the illustrated form, the arm radial lugs 19 engage into the corresponding radial grooves 62. FIG. 11 where the handle shell is removed shows the radial lugs 19 engaged in the radial grooves 62. By rotating the handle grip 3 towards a position where the handle grip is substantially superimposed with the chassis 2 longitudinal axis A, the radial lugs 19 eventually are superimposed on the retaining lips 62. The attachment part can also suitably include a ramp to form a locking wedge.

During stage two, the handle grip 2 forward end is rigidly attached to the front end of the chassis 2. FIG. 11 shows the door handle assembly 1 in this configuration.

Figure 14:
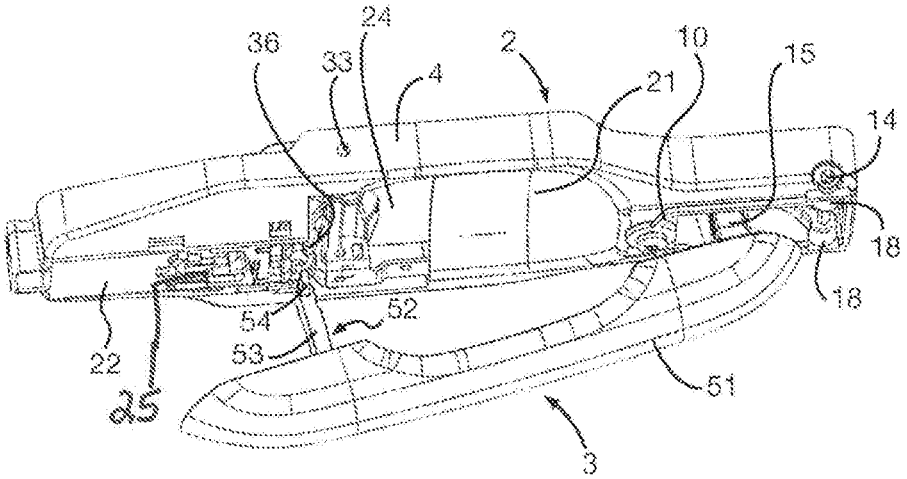
Figure 15:
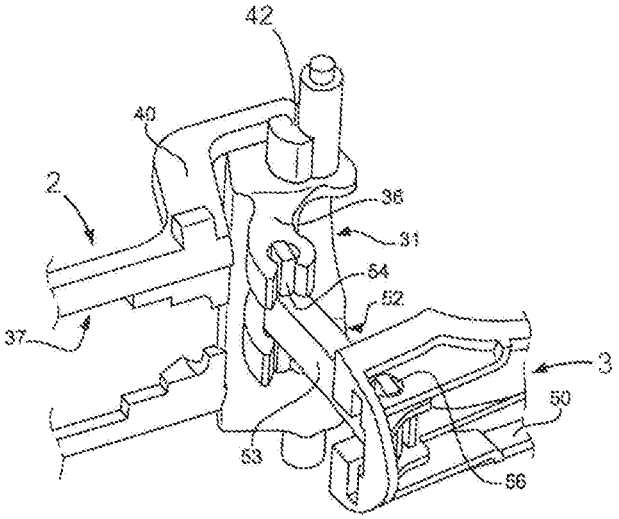
FIGS. 15 and 16 illustrate a door handle assembly rearward pivot linkage where the door panel and other components have been removed according to the present disclosure.
Figure 16:
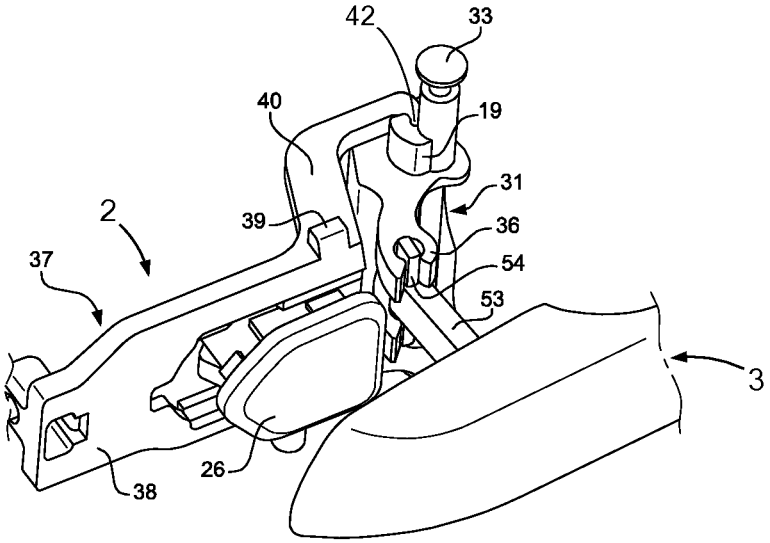

In a third stage, the handle grip 3 rotates about the forward pivot linkage and connects the plunger 52 with the bellcrank 31. To achieve this, the handle grip 3 is rotated towards the embossed area, thereby bringing the plunger 52 into engagement with the bellcrank 31 as shown in FIGS. 14 to 16. By pushing the handle grip 3, the pins 54 provided at the end of the plunger 52 engage into the bellcrank 31 locking clips, thereby creating a rearward linkage of the door handle and the chassis 2.

FIGS. 14 and 15 show the double pivot linkage formed by the plunger 52 with the handle grip 3 and formed by the plunger 52 with the bellcrank 31.

Figure 19:
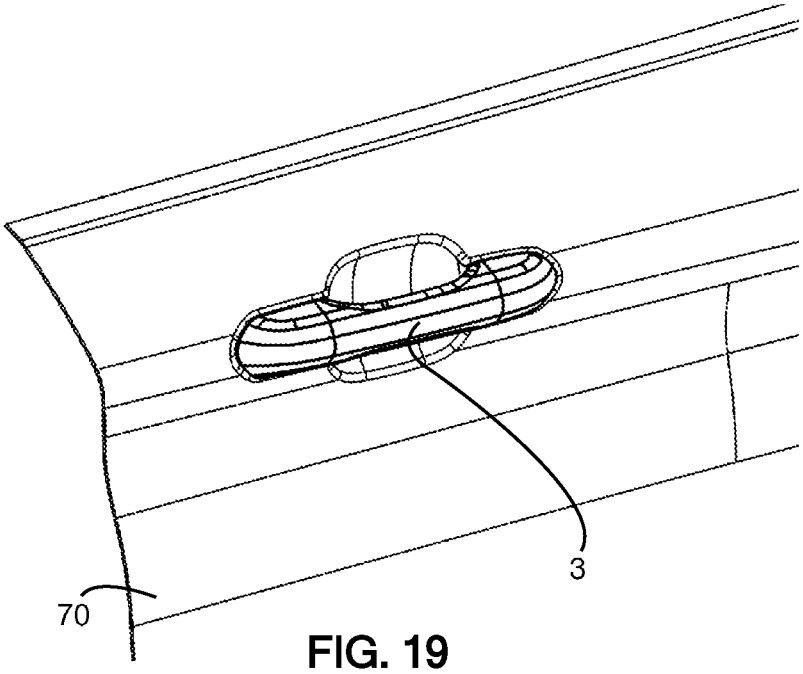
FIG. 19 illustrates an external view of a door panel assembly fitted on a door panel according to the present disclosure.

One can appreciate that the forward opening 9 of the chassis 2 and the forward passageway 75 provided in the forward embossed section 72 are sized to accommodate the arm 15 rotation and that the pivot linkage which attaches the arm 15 to the chassis 2 has a transverse dimension which is significantly higher than the transverse dimension of both chassis 2 opening and corresponding forward section passageway 75. This is made possible by providing an arm 15 which has a pivot linkage located within the internal part of the door (FIG. 18) and an attachment with the handle grip located outside of the door panel (FIG. 19). The door handle front linkage is not limited by the width of the front opening. In other words, the front pivot linkage is not limited by the width of the front opening but can be substantially wider thus providing a robust and sturdy attachment. A further aspect of the present disclosure is that, when operated, the door handle is devoid of longitudinal movement. The pivot linkage which attaches the plunger 52 onto the bellcrank 31 gives a degree of freedom in the door handle assembly 1 of the present disclosure which makes it possible for the door handle to have a pure rotation about the forward pivot linkage. The door handle assembly 1 does not have the fore and aft movement of prior art door handles which gives a user an unpleasant feeling of a loose mechanism.

Overall the door handle assembly 1 of the present disclosure gives the user a feeling of quality and smoothness as the door handle assembly 1 is devoid from undesired and interfering movements caused by a narrow forward linkage and by aft and fore movement of the door handle.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vehicular door handle assembly for opening a vehicle door, said handle assembly comprising:

a chassis assembly having a forward end and a rearward end having a rotatable bellcrank, and an arm having a first end rotatably connected to said forward end, a second end, and a central curved section between the first and second ends, the central curved section and second end of the arm extendable in a direction transverse to a longitudinal axis of the chassis assembly; and a handle grip movable to an actuated position to open a vehicle door, the handle grip having a forward end and a rearward end, said forward end having connection features to rigidly connect with the second end of the arm of the chassis, said rearward end having a plunger rotatably connected to the rearward end of the handle grip and rotatably connected to the bellcrank, wherein the arm includes a series of radial lugs and the forward end of the handle grip includes a series of radial grooves sized and spaced to receive the series of radial lugs alternating with a series of radial retaining lips sized and spaced to retain the series of radial lugs when the radial lugs engage the radial retaining lips.

2. The vehicular door handle assembly of claim 1, wherein the arm of the chassis includes connection features and the forward end of the handle grip includes complementary connection features configured to rigidly couple the handle grip to the arm when the handle grip is superimposed with the chassis longitudinal axis.

3. The vehicular door handle assembly of claim 1, wherein the handle grip includes a frame rotatably coupled to the plunger and a handle shell.

4. The vehicular door handle assembly of claim 3, wherein the handle shell and the frame define a cavity where the plunger can seat in a waiting position.

5. The vehicular door handle assembly of claim 1, wherein the bellcrank includes at least one locking clip configured to engage at least one pin of the plunger.

6. A vehicular door handle assembly securable on a vehicle door for opening the vehicle door, the vehicle door having a forward passageway and a rearward passageway, said vehicular door handle assembly comprising:

a chassis configured to be secured on an internal face of the vehicle door, the chassis having a forward end and a rearward end having a rotatable bellcrank connectable to a door latch mechanism, and an arm having a first end rotatably connected to said forward end, a second end, and a central curved section between the first and second ends, the central curved section and second end of the arm extendable in a direction transverse to a longitudinal axis of the chassis;

a handle grip movable to an actuated position to open the vehicle door, the handle grip having a forward end and a rearward end, said forward end having connection features to rigidly connect with the second end of the arm, said rearward end having a plunger rotatably connected to the rearward end of the handle grip and rotatably connected to the bellcrank wherein the arm is coupled to the chassis by pivot bearings wider than the forward passageway provided in the vehicle door.

7. The vehicular door handle assembly of claim 6, wherein the pivot bearings are located on an internal side of the vehicle door and a rigid linkage for coupling the arm to the forward end of the handle grip is located on an external side of the vehicle door.

8. A method of installing a vehicle door handle on a vehicle door having an external side and an internal side and at least a front passageway and a second passageway, the method comprising the steps of:

providing a chassis assembly having a forward end and a rearward end having a rotatable bellcrank, and an arm having a first end rotatably connected to said forward end, a second end, and a central curved section between the first and second ends, the central curved section and second end of the arm extendable in a direction transverse to a longitudinal axis of the chassis;

securing the chassis assembly to the internal side of the vehicle door;

placing the arm in the position to protrude externally through the front passageway above a surface of the vehicle door;

providing a handle grip movable to an actuated position to open the vehicle door, the handle grip having a forward end and a rearward end, said forward end having connection features to rigidly connect with the second end of the arm, said rearward end having a plunger rotatably connected to the rearward end of the handle grip and rotatably connected to the bellcrank;

mounting the forward end of the handle grip on the arm; and moving by rotation the handle grip toward the rearward end of the chassis assembly to connect the handle grip to the bellcrank wherein mounting the forward end of the handle grip to the arm includes the steps of:

providing the arm with a series of radial lugs;

providing the forward end of the handle grip with a series of radial grooves to receive the series of radial lugs, the radial grooves alternating with a series of radial retaining lips;

positioning the handle grip at an oblique angle in relation to the longitudinal axis of the chassis; and moving the handle grip at an angle such that the handle grip is superimposed to the longitudinal axis of the chassis and at least one of the radial lugs engages at least one of the retaining lips.

* * * * *